US009024819B2

(12) United States Patent
Shor

(10) Patent No.: US 9,024,819 B2
(45) Date of Patent: May 5, 2015

(54) MULTIPLE ANTENNAS HAVING GOOD ISOLATION DISPOSED IN A LIMITED SPACE

(75) Inventor: Arie Shor, Santa Clara, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1890 days.

(21) Appl. No.: 11/686,325

(22) Filed: Mar. 14, 2007

(65) Prior Publication Data

US 2007/0229364 A1 Oct. 4, 2007

Related U.S. Application Data

(60) Provisional application No. 60/744,106, filed on Mar. 31, 2006.

(51) Int. Cl.

| | |
|---|---|
| ***H01Q 1/38*** | (2006.01) |
| ***H01Q 5/00*** | (2006.01) |
| ***H01Q 21/24*** | (2006.01) |
| ***H01Q 25/00*** | (2006.01) |
| ***H01Q 9/42*** | (2006.01) |
| ***H01Q 1/22*** | (2006.01) |
| ***H01Q 1/52*** | (2006.01) |

(52) U.S. Cl.

CPC ..... *H01Q 9/42* (2013.01); *H01Q 1/2291* (2013.01); *H01Q 1/38* (2013.01); *H01Q 1/521* (2013.01); *H01Q 21/24* (2013.01); *H01Q 25/00* (2013.01)

(58) Field of Classification Search

USPC ..... 343/700 MS, 702, 795, 830, 846, 893

See application file for complete search history.

(56) References Cited

U.S. PATENT DOCUMENTS

| | | | | |
|---|---|---|---|---|
| 3,836,976 | A * | 9/1974 | Monser et al. | 343/795 |
| 4,486,758 | A * | 12/1984 | de Ronde | 343/700 MS |
| 4,672,386 | A * | 6/1987 | Wood | 343/770 |
| 4,929,959 | A * | 5/1990 | Sorbello et al. | 343/700 MS |
| 5,534,877 | A * | 7/1996 | Sorbello et al. | 343/700 MS |
| 6,538,605 | B2 | 3/2003 | Lebaric et al. | |
| 6,573,876 | B1 * | 6/2003 | Maroko et al. | 343/906 |
| 6,718,619 | B2 | 4/2004 | Lebaric et al. | |
| 6,734,828 | B2 | 5/2004 | Shor | |
| 6,741,219 | B2 | 5/2004 | Shor | |
| 6,747,605 | B2 | 6/2004 | Lebaric et al. | |
| 6,874,222 | B2 | 4/2005 | Lebaric et al. | |
| 6,883,227 | B2 | 4/2005 | Lebaric et al. | |
| 2002/0140612 | A1 | 10/2002 | Kadambi et al. | |

FOREIGN PATENT DOCUMENTS

WO 2004/017462 A1 2/2004

OTHER PUBLICATIONS

ISA/US, International Search Report and Written Opinion, International Application No. PCT/US2007/006583, Sep. 12, 2008, 4 pgs.

EPO/Munich, Supplementary European Search Report, European Patent Application No. 07753228, Search Authority, May 9, 2011, 5 pgs.

* cited by examiner

*Primary Examiner* — Michael C Wimer

(74) *Attorney, Agent, or Firm* — Holland & Hart LLP

(57) ABSTRACT

An apparatus and method are taught for instantiation of a plurality of high-frequency antennas in a limited space in a manner that provides good isolation. The instantiation may include relative rotations of linear conductors, mirror images, as well as horizontally and vertically polarized antennas. In one embodiment, the antennas may be multi-band antennas.

7 Claims, 5 Drawing Sheets

MULTIPLE ANTENNAS HAVING GOOD ISOLATION DISPOSED IN A LIMITED SPACE

RELATED APPLICATIONS

This application claims priority of U.S. Provisional Patent Application 60/744,106, entitled "Multiple Antennas Having Good Isolation Disposed In A Limited Space" filed Mar. 31, 2006.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to the field of high frequency antennas, and particularly to dual band, high frequency antennas disposed to exhibit good isolation and good diversity performance in a limited space.

2. Related Art

Wireless networking and, in particular, IEEE-802.11 compatible networking ("WiFi") has seen explosive growth. As the demand for wireless throughput increases, increasingly more complex methods must be employed to make optimal use of the limited radio frequency (RF) bandwidth. A recent RF technique called Multiple-In, Multiple-Out (MIMO) technology is being standardized as IEEE-802.11n.

MIMO makes use of the different propagation paths between various antennas to transmit a plurality of data streams simultaneously. At least one of a communicating pair of transceivers must be equipped with multiple antennas. To use the MIMO technique effectively, it is advantageous to provide isolation between the multiple antennas. In an access point, for example, substantial physical spacing can be used to separate the antennas. Client devices (e.g. PCMCIA cards used in laptop computers) may, however, lack the physical size needed to achieve meaningful physical antenna separation.

Therefore, a need arises for an apparatus and method that achieves good isolation among multiple antennas disposed in a limited space.

SUMMARY OF THE INVENTION

An apparatus and method for placing multiple high-frequency antennas in a limited space with good isolation is provided. In some embodiments, antennas having both horizontal and vertical polarization are used (i.e. antennas being instantiated on the same plane as the PCB as well as antennas being instantiated substantially above and parallel to the plane of the PCB and mounted to the PCB by connections perpendicular to the PCB). In some embodiments, antennas are instantiated in a mirror image form, thereby enhancing isolation. In some embodiments, antennas are instantiated such that their conductors are rotated relative to each other, thereby enhancing isolation. In still other embodiments, the antennas may be sized to operate at more than one narrow range of frequencies.

DETAILED DESCRIPTION OF THE FIGURES

Figure 1A:
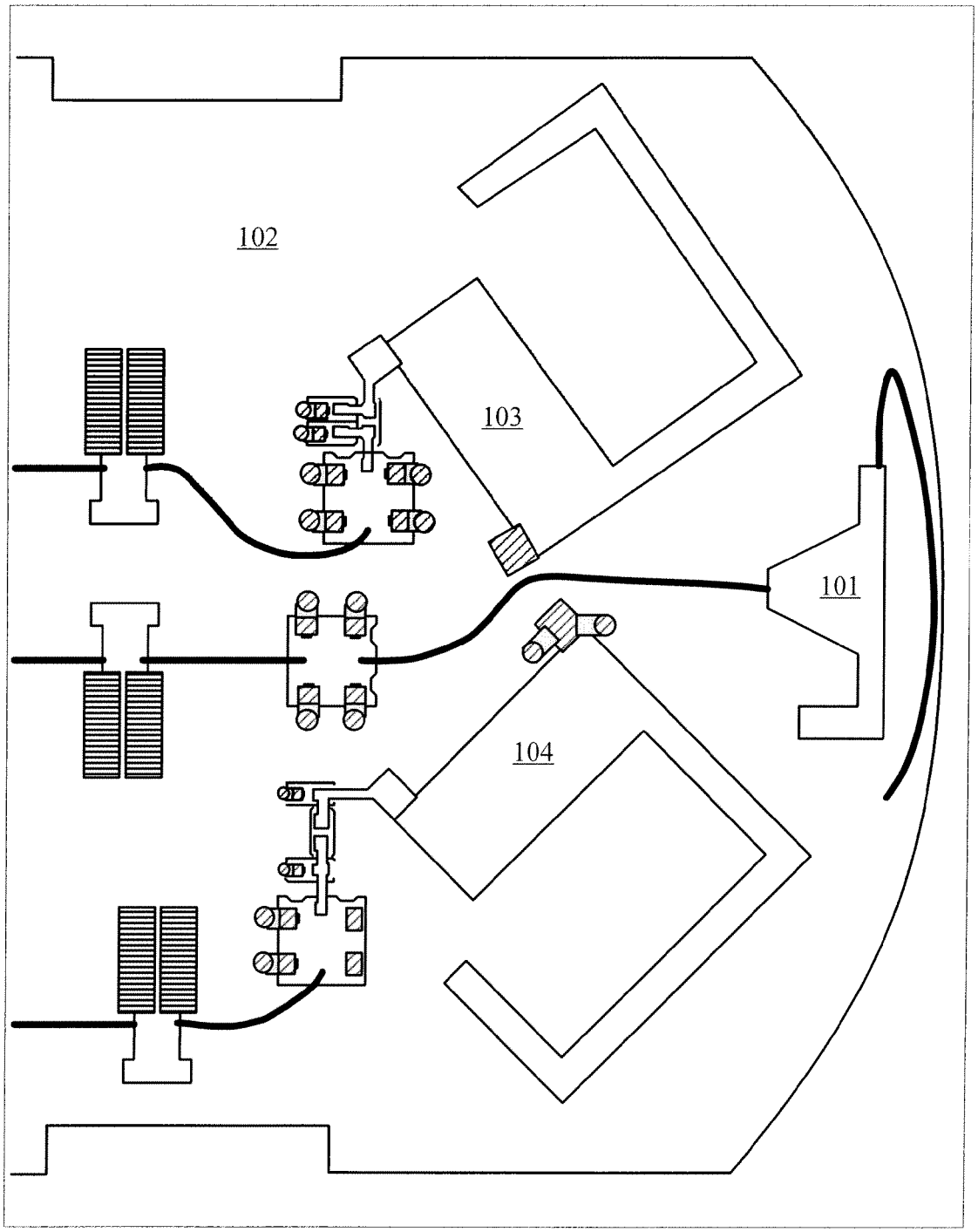
FIGS. 1A and 1B illustrate a top view of an exemplary portion of a printed circuit board (PCB) having a planar antenna formed on the PCB as well as two inverted-F antennas mounted on the PCB.

FIG. 1A illustrates various antenna instantiations that can enhance isolation. Specifically, antennas can be instantiated such that at least one antenna radiates a horizontally polarized signal and at least one other antenna radiates a vertically polarized signal. In FIG. 1A, a planar antenna 101 (which is formed on a PCB 102) can radiate a horizontally polarized signal. In other embodiments, any antenna formed on PCB 102 can be used to provide the horizontally polarized signal. In contrast, in FIG. 1A, either first inverted-F antenna 103 or second inverted-F antenna 104 (both of which are mounted to PCB 102 and thus are "above" the PCB) can radiate a vertically polarized signal. In other embodiments, any antenna formed above the PCB can be used to provide the vertically polarized signal. Notably, radiating (and, by reciprocity, receiving) both horizontally and vertically polarized signals can advantageously enhance antenna-to-antenna isolation.

In one embodiment, two antennas of the same polarized signal type may be formed in a mirror-imaged pattern, thereby enhancing antenna-to-antenna isolation. For example, in FIG. 1A, first inverted-F antenna 103 and second inverted-F antenna 104 (both antennas being the same polarized signal type, i.e. vertically polarized) are formed in a mirror-imaged pattern. Similarly, another planar antenna (not shown) could be placed in a mirror-imaged pattern with respect to planar antenna 101 (wherein both antennas would be horizontally polarized) to enhance antenna-to-antenna isolation.

Figure 1B:
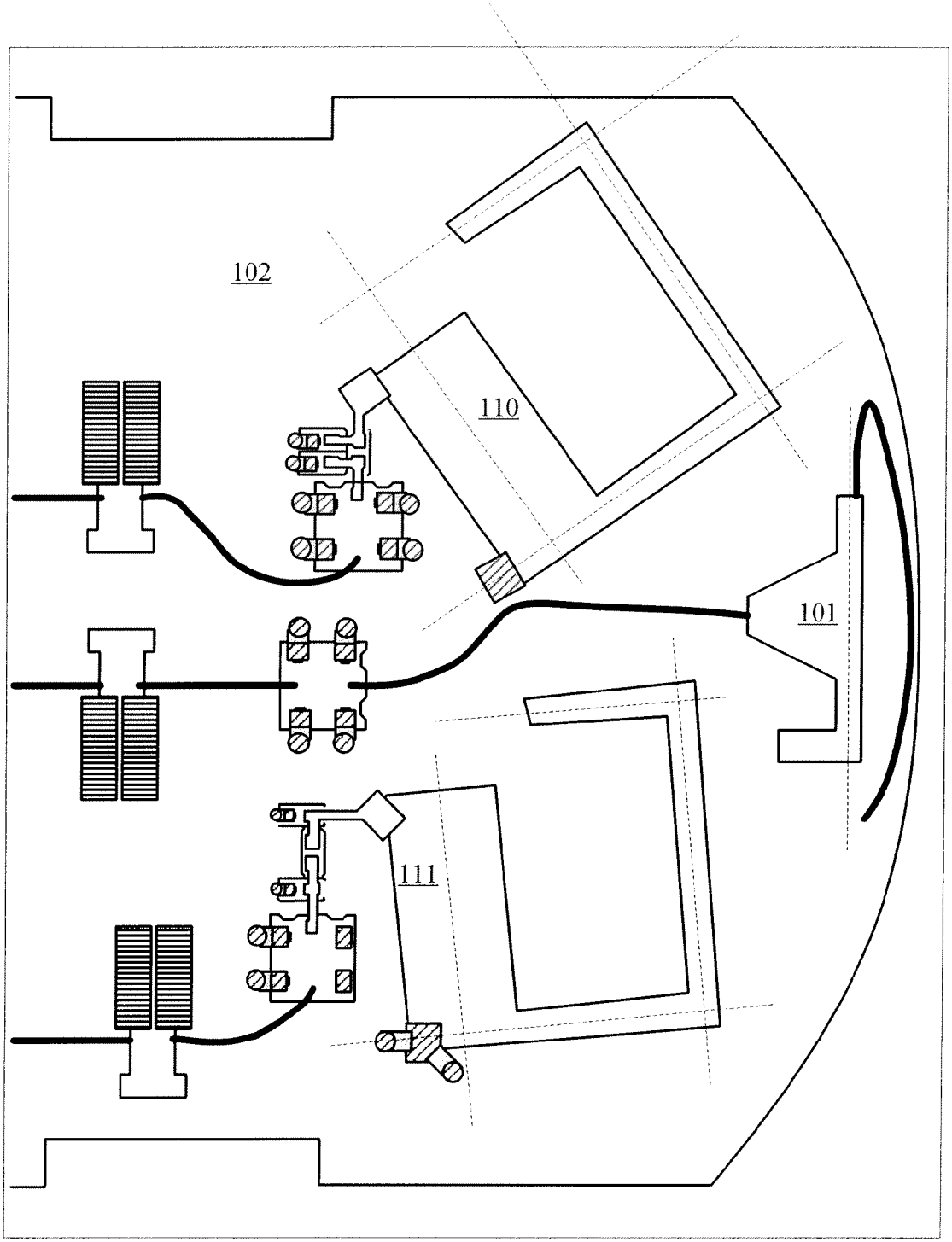

In another embodiment shown in FIG. 1B, two antennas may be rotated relative to each other, thereby enhancing antenna-to-antenna isolation and achieving different radiation patterns. For example, in FIG. 1B, an inverted-F antenna 110 is rotated with respect to an inverted-F antenna 111 to provide different radiation patterns. Different radiation patterns are advantageous for the MIMO process. In the embodiment shown in FIG. 1B, antennas 110 and 111 are the same polarized signal type, i.e. vertically polarized. In other embodiments, two antennas that are horizontally polarized can be rotated with respect to each other to provide different radiation patterns.

Referring back to FIG. 1A, in addition to the mirroring of first inverted-F antenna 103 and second inverted-F antenna 104, these antennas also exhibit a slightly different orientation. Specifically, second inverted-F antenna 104 can be characterized as being slightly rotated relative to a mirrored first inverted-F antenna 103. Thus, as shown in FIGS. 1A and 1B, any antenna can be rotated relative to any other antenna of the same type to enhance isolation. Note that although any angle of rotation may improve isolation, an angle of rotation close to 45 degrees can further improve such isolation.

Note that a first-type antenna can also be rotated relative to a second-type antenna to enhance isolation. In this case, the rotation refers to the linear conductors of each antenna. For example, referring to FIG. 1B, both inverted-F antennas 110 and 111 have four linear conductors, which are shown with dashed lines. Planar antenna 101, in contrast, includes one linear conductor, which is also shown with dashed lines. In one embodiment, a rotation of approximately 45 degrees between linear conductors of different type antennas provides an optimized isolation. Therefore, for example, in FIG. 1B, the rotation of the linear conductors of inverted-F antenna 110 relative to the linear conductor of planar antenna 101 (which is close to a 45 degree offset) may provide better isolation than the rotation of the linear conductors of vertically polarized antenna 111 relative to the linear conductor of horizontally polarized antenna 101 (which is either significantly less than or greater than a 45 degree offset).

Figure 2:
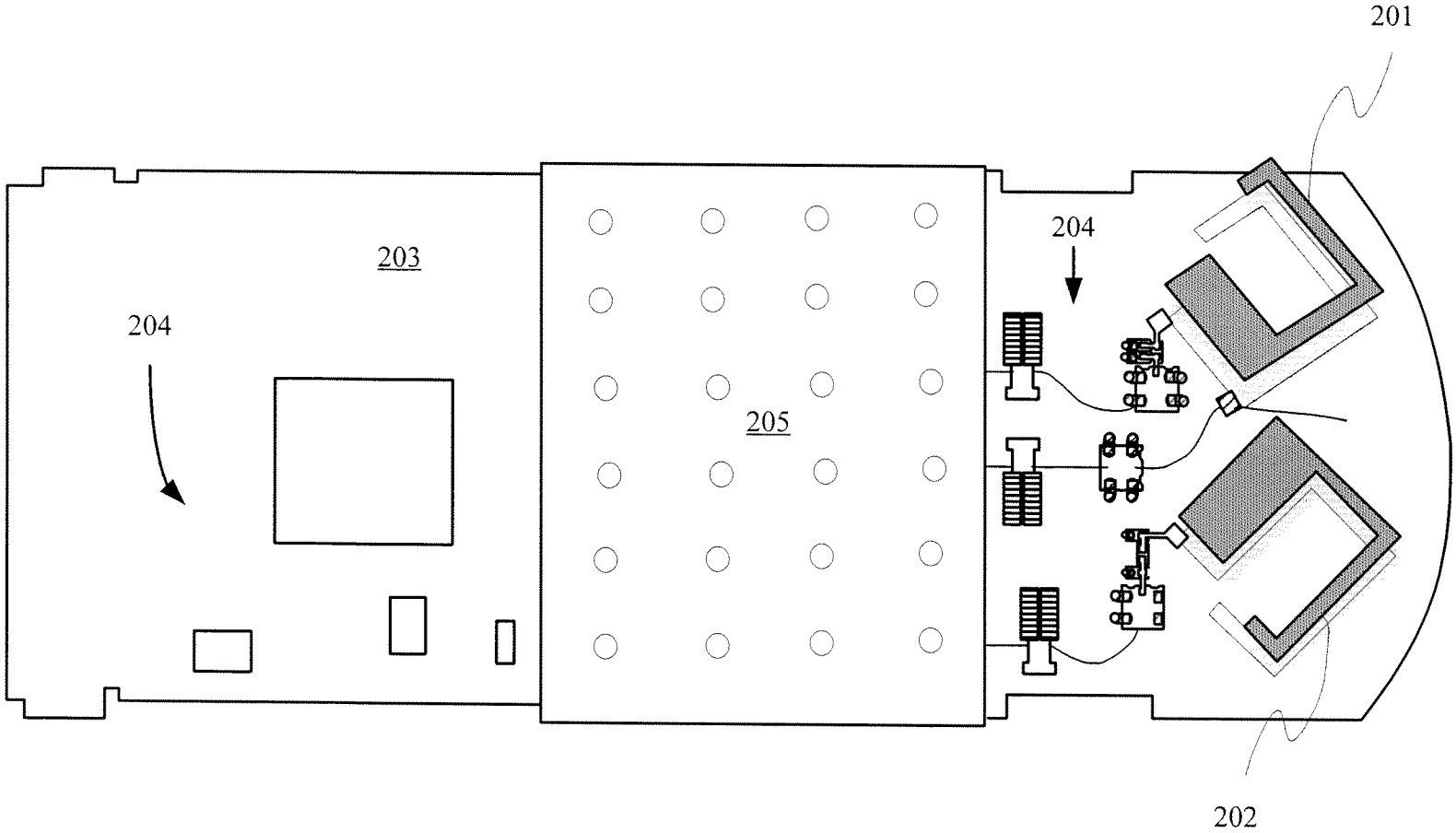
FIG. 2 illustrates a view of the PCB with mounted inverted-F antennas as well as ancillary circuitry. For simplicity, only the mounted inverted-F antennas are shown with a slight perspective form.

FIG. 2 illustrates an instantiation of two inverted-F antennas 201 and 202 mounted on a PCB 203. When mounted, each antenna includes radiating and loading elements displaced vertically from the surface of a PCB 203. For simplicity, a horizontally polarized antenna, which would be formed on PCB 203, is not shown. Also for simplicity, only the mounted inverted-F antennas 201 and 202 are shown with a slight perspective form (i.e. PCB 203, exemplary ancillary circuitry 204, and a shield 205 are shown from a top view). Notably, the mounting of antennas 201 and 202, which provides separation between the antennas and PCB 203, also advantageously enhances isolation.

Figure 3:
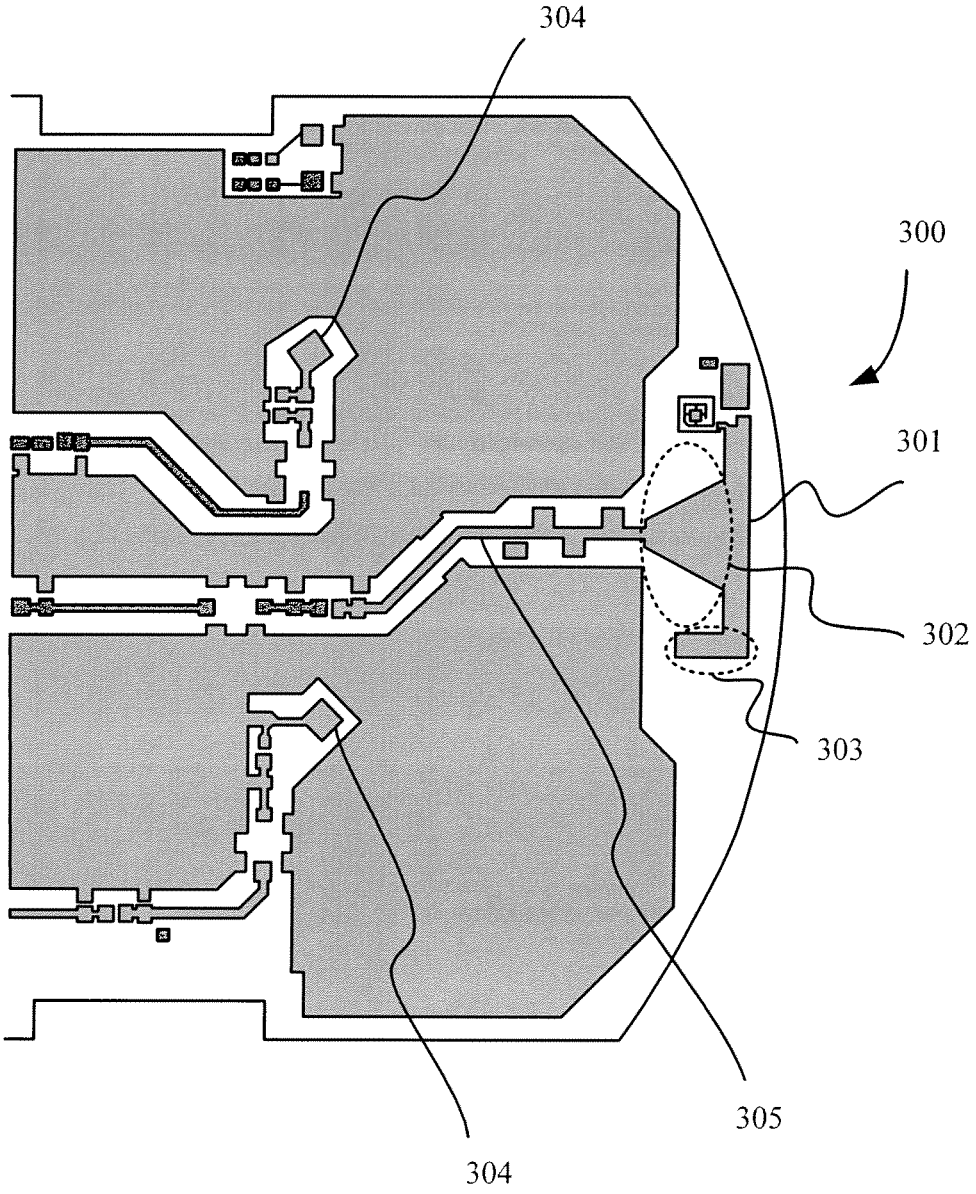
FIG. 3 illustrates an exemplary planar antenna formed on a PCB layer.

FIG. 3 illustrates an exemplary planar antenna 300 formed on a PCB layer. Planar antenna 300 includes a linear conductor portion 301 (also described in reference to FIG. 1B), an impedance matching portion 302, and a load portion 303. Note that FIG. 3 shows other structures formed on the PCB layer, e.g. two contacts 304 for the vertically polarized antennas (e.g. each contact to receive one of the tab ends of the inverted-F antenna described in reference to FIG. 4C) and a transmission line 305 to planar antenna 300.

Figure 4A:
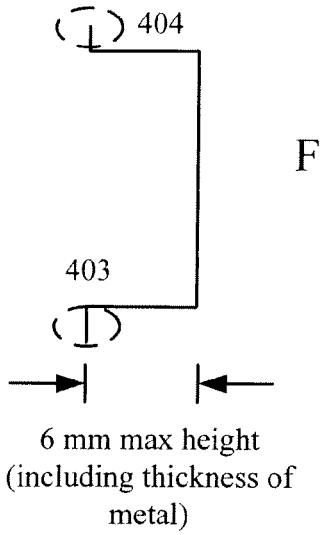
FIGS. 4A, 4B, and 4C illustrate side, top, and flat views of an exemplary inverted-F dual band antenna providing dual-band functionality.
Figure 4B:
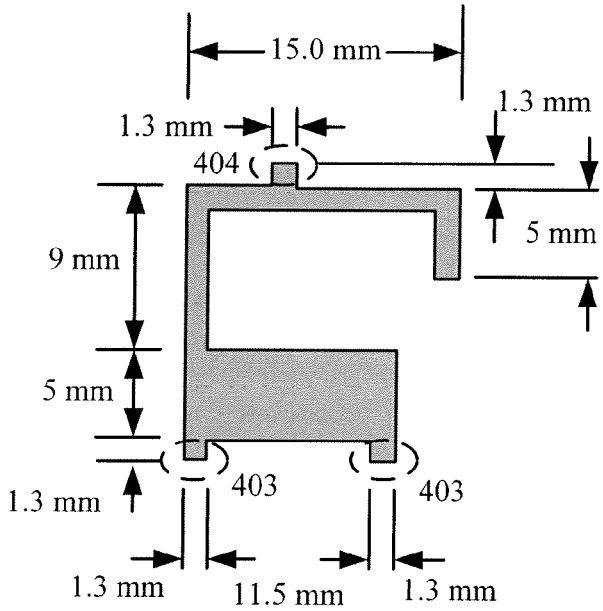
Figure 4C:
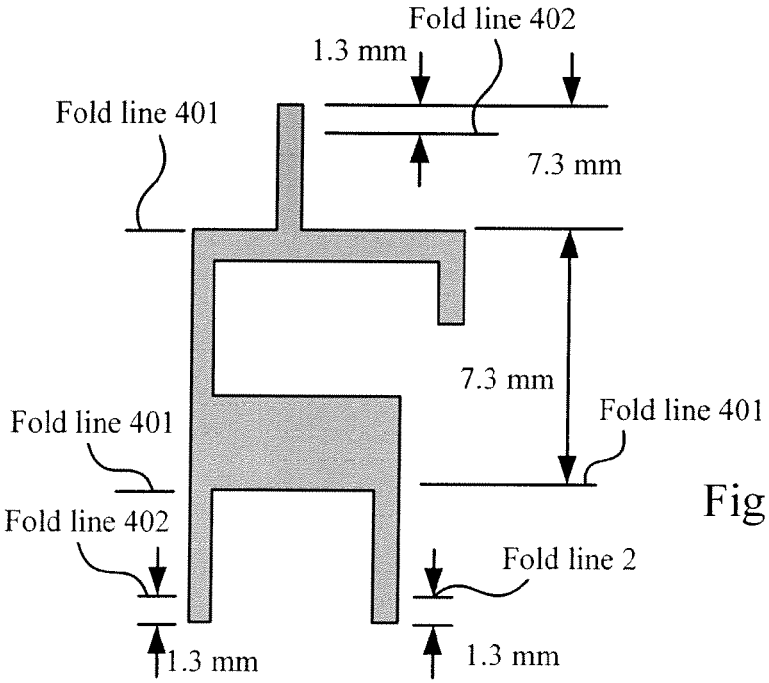

FIGS. 4A, 4B, and 4C illustrate side, top, and flat views of an exemplary inverted-F antenna. The dimensions indicated on these figures can advantageously facilitate the antenna's operation in either or both of the 2.4 GHz band (i.e. 2.4-2.4835 GHz) and the 5 GHz band (i.e. 4.9-5.9 GHz), thereby resulting in a dual-band antenna.

The inverted-F antenna shown in FIGS. 4A, 4B, and 4C can be advantageously formed from planar sheet (i.e. conducting) metal (e.g. 0.15-0.2 mm thick) that includes pre-plated tabs for solderability. Referring to FIG. 4C, fold lines 401 indicate where tabs can be folded perpendicular to the plane of the body of the inverted-F antenna (i.e. at 90 degrees). Fold lines 402 indicate where ends of the tabs are folded (i.e. at 90 degrees) to be parallel to and directed away from the plane of the body of the inverted-F antenna. These tab ends 403 and 404 are shown in FIGS. 4A and 4B (i.e. these views would not show the vertical tabs perpendicular to the plane of the body of the antenna). In fabrication, tab ends 403 and 404 can be used to make electrical contact with the PCB (e.g. with solder). In one embodiment, tab ends 404 (both vertical and horizontal portions) can be trimmed after assembly.

Note that for the purpose of clarity, technical material that is known in the technical fields related to the invention has not been described in detail so that the present invention is not unnecessarily obscured.

Although illustrative embodiments of the invention have been described in detail herein with reference to the accompanying figures, it is to be understood that the invention is not limited to those embodiments. These embodiments are not intended to be exhaustive or to limit the invention to the precise forms disclosed. As such, many modifications and variations will be apparent. For example, in one embodiment, antennas may be instantiated such that the antennas are advantageously polarized similarly to an access point with which the antennas will communicate. Accordingly, it is intended that the scope of the invention be defined by the following Claims and their equivalents.

The invention claimed is:

1. A method of disposing antennas in a limited space, the method comprising:

instantiating a horizontally polarized antenna on a PCB surface, wherein the horizontally polarized antenna is instantiated in a same plane as the PCB surface;

mounting a first vertically polarized antenna above the PCB surface, wherein the first vertically polarized antenna is mounted substantially parallel to the PCB surface;

mounting a second vertically polarized antenna above the PCB surface, wherein the second vertically polarized antenna is mounted substantially parallel to the PCB surface; and positioning the first and second vertically polarized antennas to enhance isolation relative to the horizontally polarized antenna; wherein a linear conductor of the first vertically polarized antenna is rotated relative to a corresponding linear conductor of the second vertically polarized antenna.

2. The method of claim 1, wherein positioning the first and second vertically polarized antennas comprises:

rotating a linear conductor of the first vertically polarized antenna relative to a linear conductor of the horizontally polarized antenna; and rotating a linear conductor of the second vertically polarized antenna relative to a linear conductor of the horizontally polarized antenna.

3. The method of claim 1, wherein positioning the first and second vertically polarized antennas includes positioning the second vertically polarized antenna as a mirror image of the first vertically polarized antenna.

4. A wireless apparatus comprising:

a horizontally polarized antenna disposed directly on a PCB surface; and a first vertically polarized antenna disposed above the PCB surface and mounted substantially parallel to the PCB surface;

a second vertically polarized antenna disposed above the PCB surface and mounted substantially parallel to the PCB surface, wherein a linear conductor of the first vertically polarized antenna is rotated relative to a corresponding linear conductor of the second vertically polarized antenna;

and wherein the horizontally polarized antenna and each vertically polarized antenna are further disposed so as to enhance isolation from each other.

5. The wireless apparatus of claim 4, wherein a linear conductor of each vertically polarized antenna is rotated relative to a linear conductor of the horizontally polarized antenna.

6. The wireless apparatus of claim 4, wherein the second vertically polarized antenna is positioned as a mirror image of the first vertically polarized antenna.

7. The wireless apparatus of claim 4, wherein dimensions of the first and second vertically polarized antennas provide dual-band functionality.

* * * * *